US007685657B1

(12) United States Patent
Hernandez et al.

(10) Patent No.: US 7,685,657 B1
(45) Date of Patent: Mar. 30, 2010

(54) AUTOMATED ROCKING BASSINET

(76) Inventors: Macos E. Hernandez, 1047 NW. 133rd Ave., Miami, FL (US) 33182; Mayelin Hernandez, 1047 NW. 133rd Ave., Miami, FL (US) 33182

( * ) Notice: Subject to any disclaimer, the term of this patent is extended or adjusted under 35 U.S.C. 154(b) by 0 days.

(21) Appl. No.: 12/029,211

(22) Filed: Feb. 11, 2008

(51) Int. Cl.
*A47D 9/02* (2006.01)

(52) U.S. Cl. ..... 5/109; 5/101

(58) Field of Classification Search ..... 5/101–109, 5/93.1, 634, 648
See application file for complete search history.

(56) References Cited

U.S. PATENT DOCUMENTS

| | | | | |
|---|---|---|---|---|
| 3,060,461 | A * | 10/1962 | Lyles et al. | 5/109 |
| 3,696,233 | A * | 10/1972 | Pulsifer | 219/535 |
| 3,882,556 | A | 5/1975 | Accurso | |
| 4,028,753 | A | 6/1977 | Rios | |
| 4,891,852 | A | 1/1990 | Lopez, Jr. | |
| 5,003,651 | A | 4/1991 | Rosen | |
| 5,553,337 | A * | 9/1996 | Lin | 5/109 |
| 5,931,534 | A | 8/1999 | Hutter | |
| 6,386,986 | B1 * | 5/2002 | Sonner et al. | 5/109 |
| 6,915,536 | B2 * | 7/2005 | Chen | 5/93.1 |
| 7,275,273 | B2 * | 10/2007 | Lary et al. | 5/634 |
| 2004/0140304 | A1 * | 7/2004 | Leyendecker | 219/386 |
| 2004/0181873 | A1 * | 9/2004 | Waldman et al. | 5/101 |
| 2004/0244111 | A1 | 12/2004 | Williams | |
| 2005/0210580 | A1 * | 9/2005 | Clapper | 5/93.1 |
| 2009/0070929 | A1 * | 3/2009 | Holman | 5/93.1 |

* cited by examiner

*Primary Examiner*—Peter M Cuomo
*Assistant Examiner*—Brittany M Wilson

(57) ABSTRACT

An automated rocking bassinet apparatus includes a support that includes a first upper panel and a second upper panel. A plurality of legs is attached to and extends downwardly from each of the first and second upper panels. A housing includes a bottom wall and a peripheral wall that is attached to and extends upwardly from the bottom wall. A pair of receivers is attached to the housing. A pair of mountings is provided. Each of the first and second upper panels has one of the mountings attached thereto and each of the receivers receives one of the mountings to pivotally couple the housing to the support. A driver assembly is mounted in the first upper panel and selectively rocks the housing with respect to the support.

18 Claims, 9 Drawing Sheets

AUTOMATED ROCKING BASSINET

BACKGROUND OF THE INVENTION

Field of the Invention

The present invention relates to bassinet devices and more particularly pertains to a new bassinet device for automatically rocking a child as well as providing vibrations and sounds to soothe the child.

SUMMARY OF THE INVENTION

The present invention meets the objectives presented above by generally comprising a support that includes a first upper panel and a second upper panel. A plurality of legs is attached to and extends downwardly from each of the first and second upper panels so that each of the first and second upper panels has two legs attached thereto. Each of the first and second upper panels has an inner face and an outer face. A brace extends between the legs and retains the first and second upper panels in a vertical orientation. A housing includes a bottom wall and a peripheral wall that is attached to and extends upwardly from the bottom wall. A pair of receivers is attached to the housing. A pair of mountings is provided. Each of the first and second upper panels has one of the mountings attached thereto and each of the receivers receives one of the mountings to pivotally couple the housing to the support. A driver assembly is mounted in the first upper panel and selectively rocks the housing with respect to the support. An actuating assembly is mounted on the support and is in communication with the driver assembly to selectively turn on or turn off the driver assembly. A remote actuator is in wireless communication with the actuating assembly to wirelessly turn on or off the driver assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
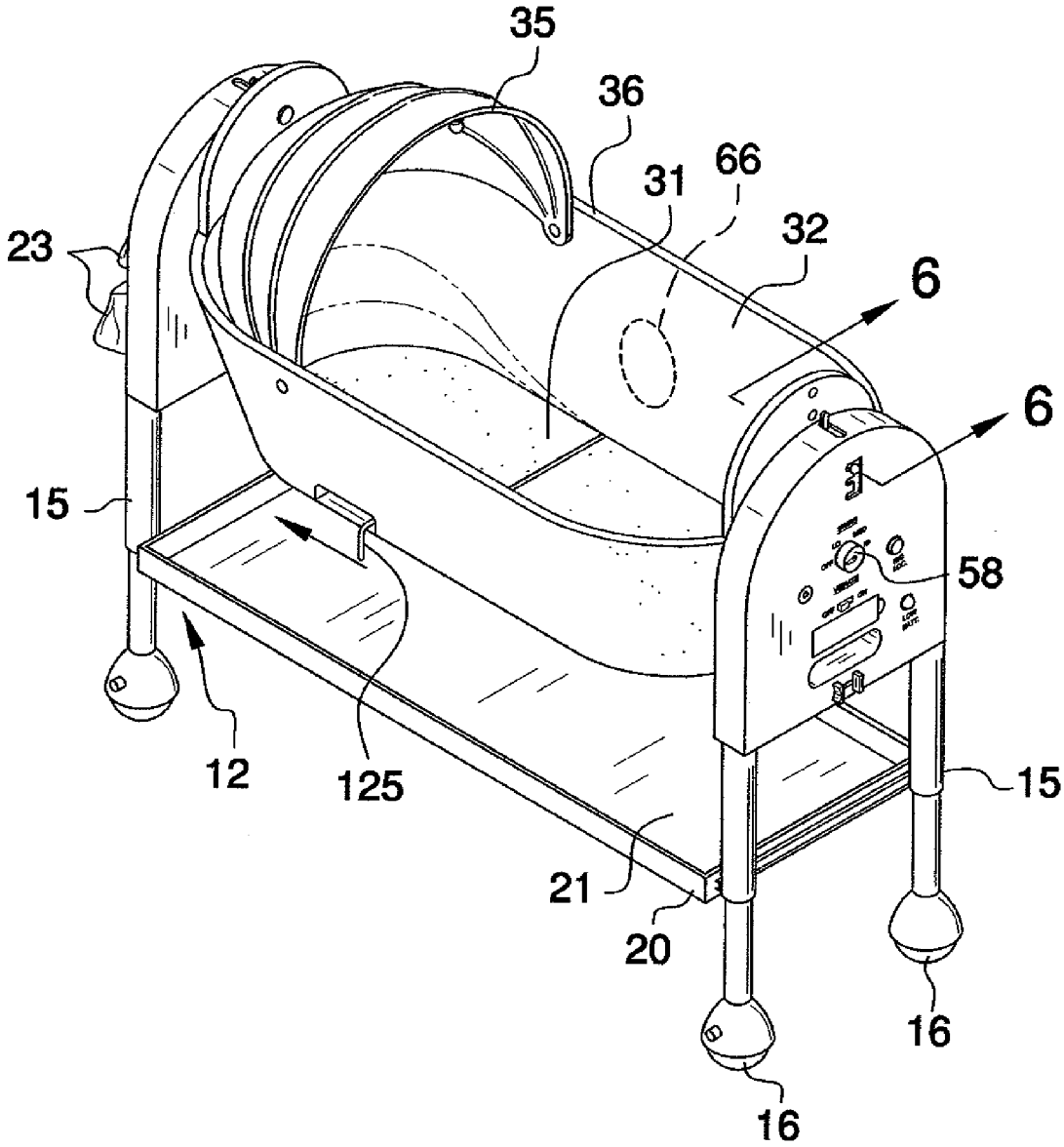
FIG. 1 is a right side and top perspective view of an automated rocking bassinet apparatus according to the present invention.
Figure 2:
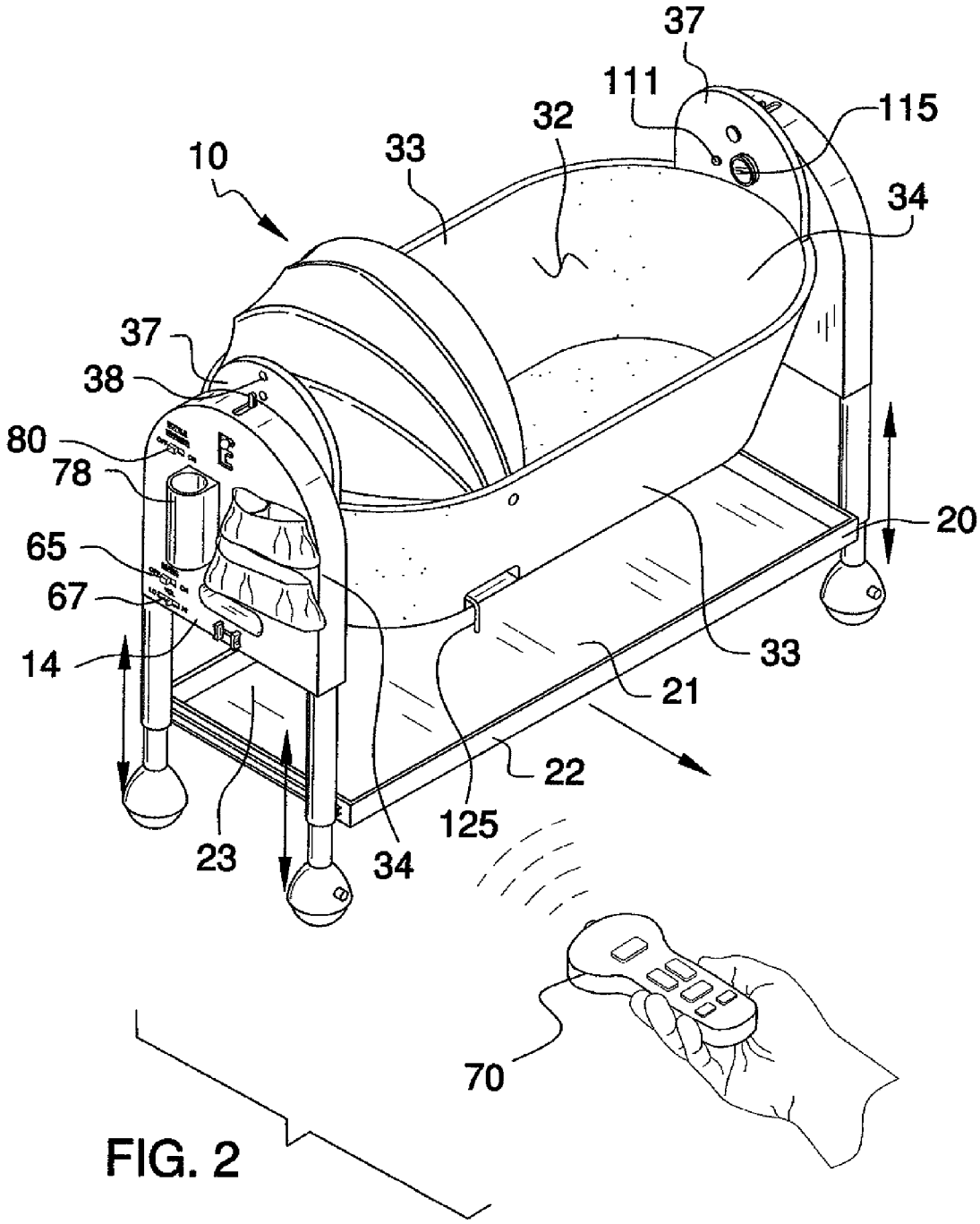
FIG. 2 is a left side and top perspective view of the present invention.

With reference now to the drawings, and in particular to FIGS. 1 through 8 thereof, a new bassinet device embodying the principles and concepts of the present invention and generally designated by the reference numeral 10 will be described.

As best illustrated in FIGS. 1 through 8, the automated rocking bassinet apparatus 10 generally comprises a support 12 that includes a first upper panel 13 and a second upper panel 14. A plurality of legs 15 is attached to and extends downwardly from each of the first 13 and second 14 upper panels so that each of the first 13 and second 14 upper panels has two legs 15 attached thereto. Each of the legs terminates with a lockable roller 16. Each of the first 13 and second 14 upper panels has an inner face 17 and an outer face 18. A brace 20 extends between the legs 15 and retains the first 13 and second 14 upper panels in a vertical orientation. Each of the legs 15 is telescopic and has an adjustable height. The brace 20 includes a horizontally oriented tray 21 and a perimeter wall 22 is attached to and extending upwardly from the tray 21 so that the brace 20 may be used for storing items for an infant. Storage sacks 23 are mounted on the support 12 for holding any variety of items.

Figure 3:
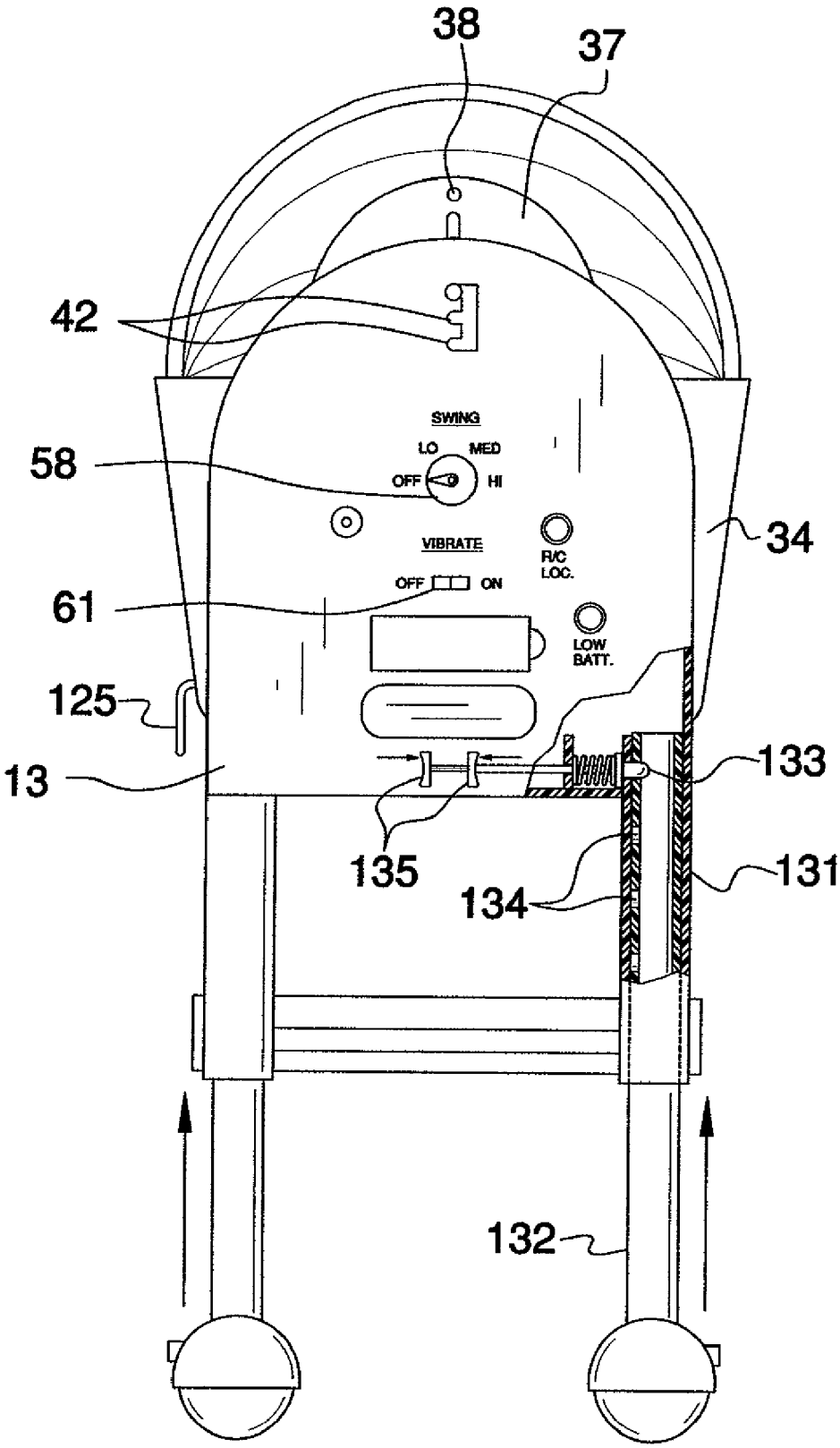
FIG. 3 is a right side view of the present invention.
Figure 4A:
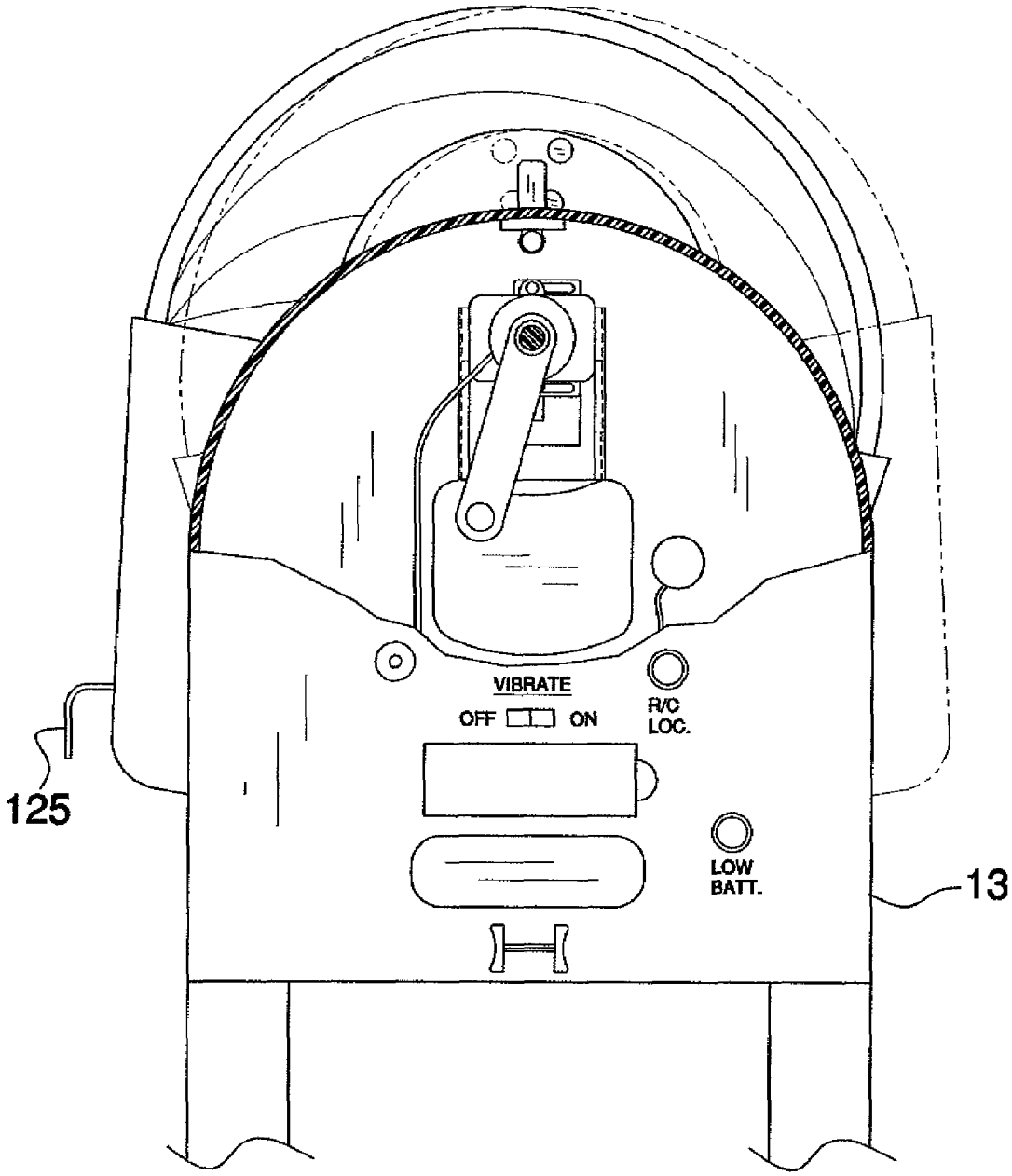
FIG. 4*a* is a right side broken view of the present invention showing a housing in a raised position.
Figure 4B:
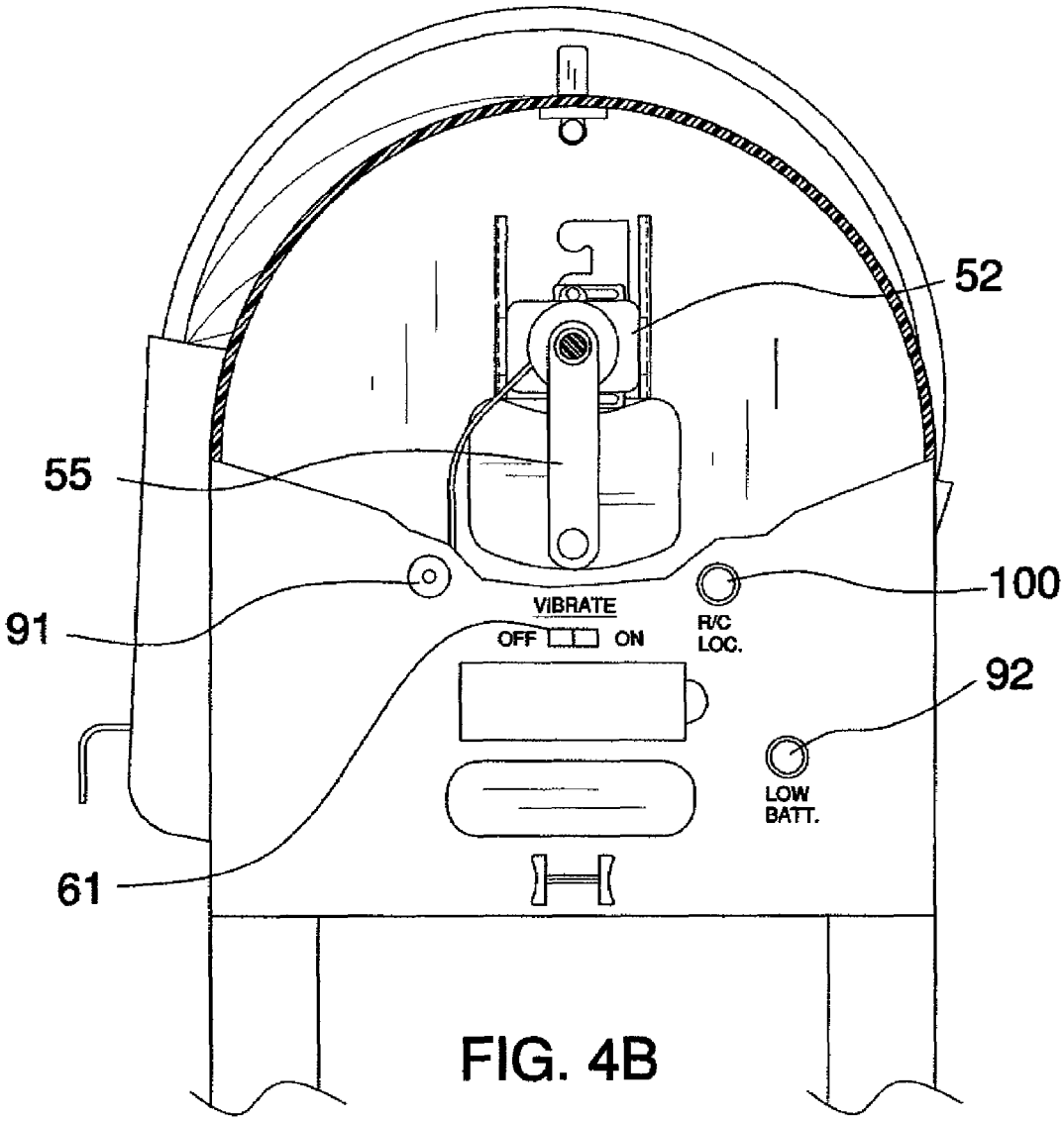
FIG. 4*b* is a right side broken view of the present invention showing the housing in a lowered position.

Each of the legs 15, as shown in FIG. 3, includes a first leg section 131 and a second leg section 132 slidably coupled to each other. The roller 16 of each leg is attached to the bottom end of the second leg section 132. A nub 133 extends through the first leg section 131 and into the second leg section 132 to lock the first 131 and second 132 leg sections at a selected height. The second leg section 132 includes a plurality of vertically aligned holes 134. The nub 133 is removably extended into one of the holes 134. The nub 133 is biased in one of the holes 134 and a lever 135 attached to the nub 133 allows the nub to be urged outwardly of the second leg section. Preferably the levers 135 of two adjacent legs are positioned adjacent to each other to allow actuation of two nubs at one time as is shown in FIG. 3.

Figure 5:
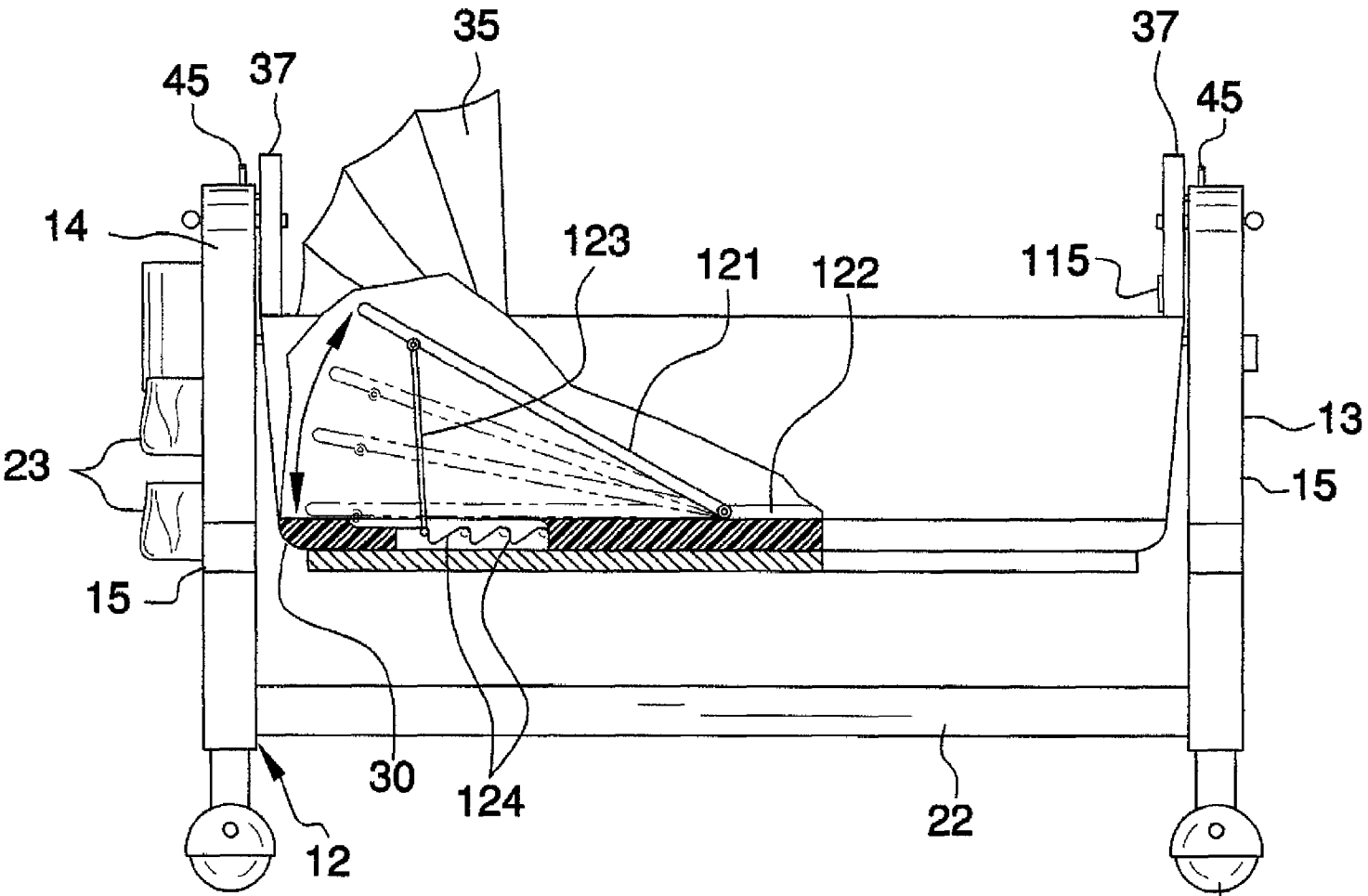
FIG. 5 is a back view of the present invention.
Figure 6:
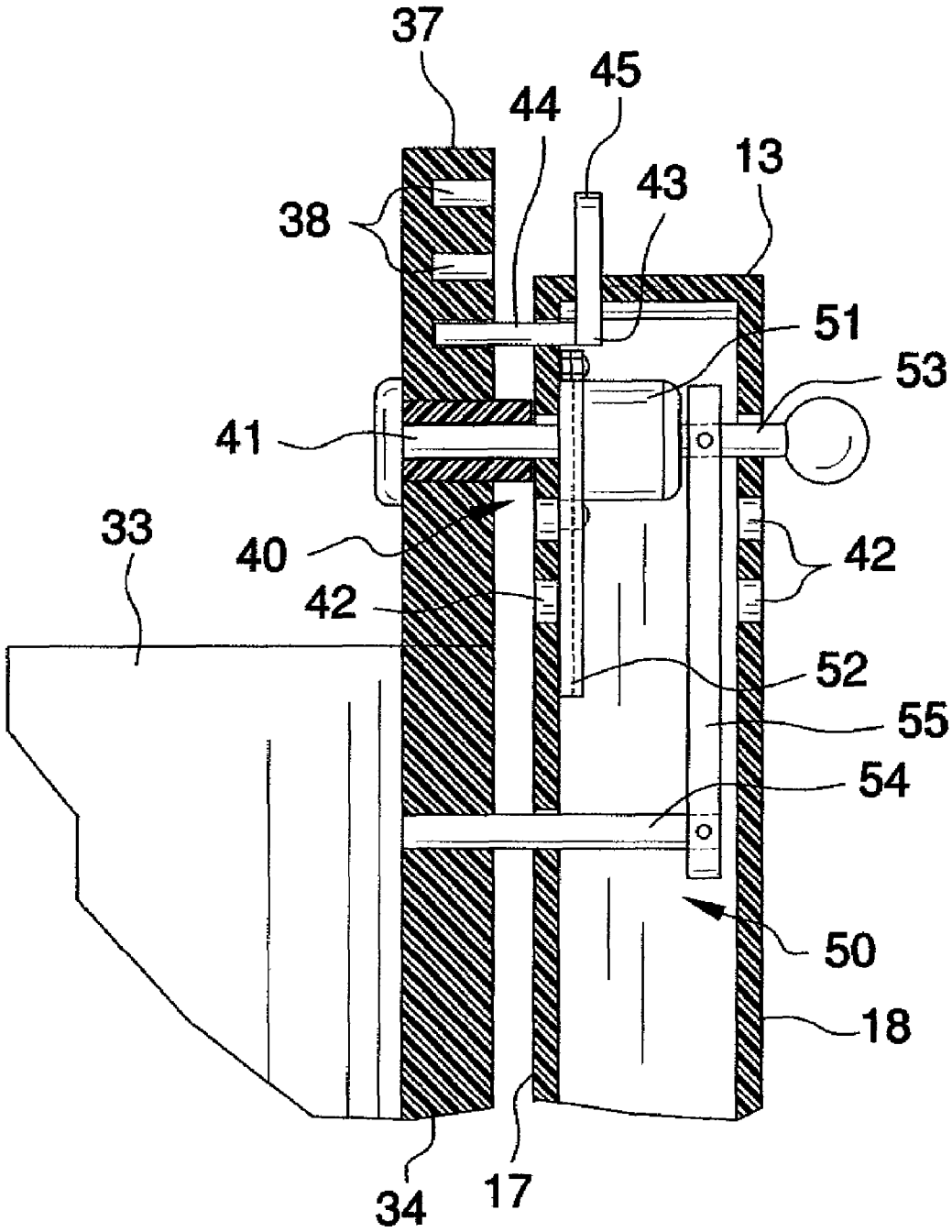
FIG. 6 is a cross-sectional view taken along line 6-6 of FIG. 1 the present invention.
Figure 7:
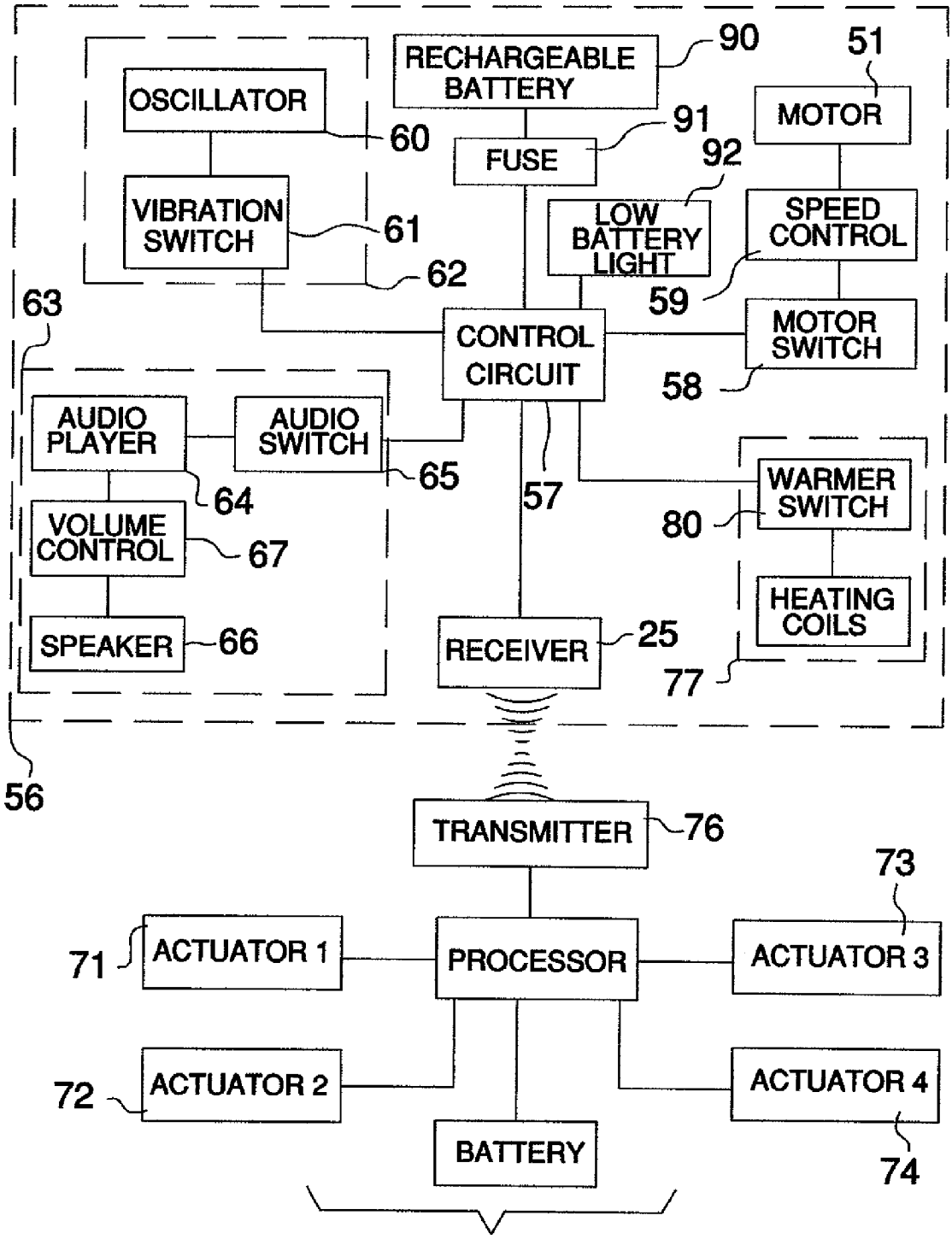
FIG. 7 is a schematic view of the present invention.
Figure 8:
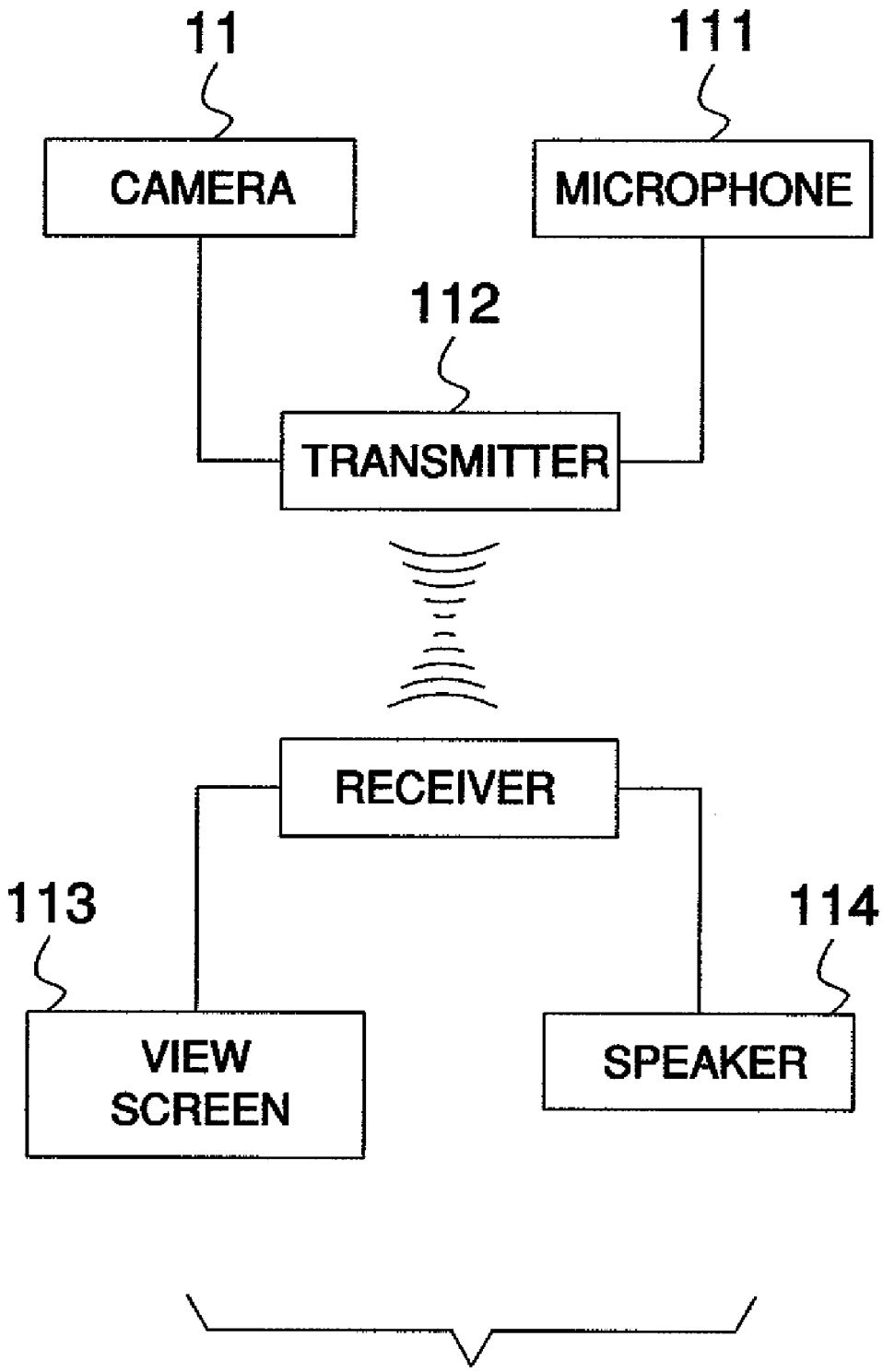
FIG. 8 is a schematic view of a monitor of the present invention

A housing 30 includes a bottom wall 31 and a peripheral wall 32 that is attached to and extends upwardly from the bottom wall 31. The peripheral wall 32 includes a pair of lateral walls 33 and a pair of end walls 34. An accordion type shroud 35 is attached to the peripheral wall 32 and is selectively positioned in an extended position covering a portion of an opening defined by an upper edge 36 of the peripheral wall 32 or in a collapsed position. The bottom wall 31 includes a first section 121 and a second section 122 wherein the first section 121 is hingedly coupled to the second section 122 so that the first section 121 may be angled as shown in FIG. 5. A lift bar 123 is positioned under and pivotally coupled to the first section 121. The lift bar 123 may be locked into a plurality of receiving notches 124 and moved between the receiving notches 124 by a lift actuator 125 extending through the peripheral wall 32.

A pair of receivers 37 is attached to the housing 30. Each of the end walls 34 has one of the receivers 37 attached thereto and the receivers 37 extend upwardly from the end walls 34. The receivers 37 will form part of the pivot point of the housing 30 and by extending upwardly from the housing 30 place the center of gravity of the housing 30 well below the pivot point.

A pair of mountings 40 is provided. Each of the first 13 and second 14 upper panels has one of the mountings 40 attached thereto. Each of the receivers 37 receives one of the mountings 40 to pivotally couple the housing 30 to the support 12. Each of the mountings 40 includes a pivot rod 41 extending into an associated one of the receivers 37 and extending through the inner 17 and outer 18 faces. Each of the inner 17 and outer 18 faces has vertically aligned spacer notches 42 therein. The pivot rod 41 is selectively positioned in one of the spacer notches 42 to allow selective vertical movement of the pivot rod 41 vertically with respect to the support 12. The housing's 30 weight is supported by the pivot rod 41 and the pivot rod 41 allows the housing 30 to pivot relative to the support 12. A locking member 43 is releasably extended into the associated one of the receivers 37 and is slidably coupled to a corresponding one of the first 13 and second 14 upper panels. The locking member 43 prevents the housing 30 from pivoting with respect to the support 12. The locking member 43 includes a catch portion 44 and a grip portion 45. The catch portion 44 extends into one of a plurality of aligned apertures 38 in the receivers 37. The aperture 38 that is used corresponds to the spacer notches 42. The grip portion 45 extends upwardly through an associated one of the first 13 and second 14 upper panels and is simply slid away from the receiver 37 to allow rocking of the housing 30 or extended into the receiver 37 to stop rocking.

A driver assembly 50 is mounted in the first upper panel 13 and selectively rocks the housing 30 with respect to the support 12. The driver assembly 50 includes a motor 51 that is mounted to a plate 52 coupled to the pivot rod 41 positioned in the first upper panel 13. A drive shaft 53 mounted to the motor 51 is rotated alternately in opposite directions when the motor 51 is turned on. The drive shaft 53 may be hollow to allow the pivot rod to extend through the drive shaft 53. An arm 54 is attached to the housing 30 and extends through a large opening in the inner face 17 of the first upper panel 13 which allows lateral and vertical movement of the arm 54 relative to the support. A connecting rod 55 extends between and couples together the arm 54 and the drive shaft 53. The connecting rod 55 movies the arm 54 back and forth with a movement of the drive shaft 53 mechanically coupled to the motor 51.

An actuating assembly 56 is in communication with the driver assembly 50 to selectively turn on or turn off the driver assembly 50. The actuating assembly 56 includes a control circuit 57 that is mounted in the support 12 and is electrically coupled to the motor 51. The control circuit 57 may include any conventional processor or circuit used for control electronics. A motor switch 58 is mounted on the support 12 and electrically coupled to the control circuit 57. The motor switch 58 is movable to an on position or off position to selectively turn the motor 51 or on off. A speed control 59 is electrically coupled to the control circuit 57 and is mounted on the support 12. The motor switch 58 and speed control 59 may be encapsulated into one switch. The speed control 59 is actuated to adjust a speed of the motor 51. A signal receiver 25 is electrically coupled to the control circuit 57.

A vibration assembly 62 is mounted in the support and vibrates the support 12 and the housing 30 when the vibration assembly is turned on. The vibration assembly includes an oscillator mounted 60 within one of the first 12 and second 13 upper panels and a vibration switch 61 in electrical communication with the oscillator 60.

A sound playing assembly 63 is mounted to the support 12. The sound playing assembly 63 includes an audio player 64 including a plurality of electrically recorded sounds. An audio switch 65 is electrically coupled to the audio player 64. The audio switch 65 is movable to an on position or off position to selectively turn the audio player 64 or on off. At least one speaker 66 is electrically coupled to the audio player 64 and audibly plays the electronically recorded sounds when the audio player 64 is turned on. The speaker 66 is positioned in the housing 30. A volume control 67 is mounted on the support 12. A volume level of sound emitted by the at least one speaker 66 is adjusted by actuating the volume control 67.

A remote actuator 70 is in wireless communication with the actuating assembly 56. The remote actuator 70 includes a transmitter 76 to send a wireless signal to the signal receiver 25. A first actuator 71 is electrically coupled to the transmitter 76 and the transmitter 76 sends a signal to the control circuit 57 to turn on the motor 51 when the first actuator 71 is actuated. A second actuator 72 is electrically coupled to the transmitter 76 and the transmitter 76 sends a signal to the control circuit 57 to turn off the motor 51 when the second actuator 72 is actuated. A vibration actuator 73 is electrically coupled to the transmitter 57. The vibration assembly 62 is electrically coupled to the control circuit 57. The transmitter 76 sends a signal to the control circuit 57 to turn on the vibration assembly 62 when the vibration actuator 73 is actuated. An audio actuator 74 is electrically coupled to the transmitter 76. The sound playing assembly 63 is electrically coupled to the control circuit 57. The transmitter 76 sends a signal to the control circuit 57 to turn on the audio player 64 when the audio actuator 74 is actuated.

A bottle warmer 77 is mounted on the support 12. The bottle warmer 77 includes a sleeve 78 into which a bottle is removably positioned. The bottle warmer 77 includes heating elements 79 to warm the sleeve. A warming switch 80 is electrically coupled to the bottle warmer 77. The warming switch 80 is movable to an on position or an off position to selectively turn the bottle warmer 77 on or off.

A rechargeable battery 90 is mounted in the support 12 and is electrically coupled to each of the driver assembly 50, bottle warmer 77, vibration assembly 62 and sound playing assembly 63. A conventional power cord may also be used in place of or as an auxiliary power source when plugged into an electrical outlet. An emergency fuse 91 cuts power to the control circuit if power levels are too high and a light emitter 92 is coupled to the control circuit to indicate lower power levels. The support may also include a locate actuator 100 to send a wireless signal to the remote control 70 to sound an audible alarm positioned in the remote control 70 to locate the remote control.

A combination remote camera 115 and microphone 111 is attached to the housing 30 opposite the shroud 35 and is directed toward the first section 131 of the bottom wall 31. The camera 115 is electrically coupled to a transmitter 112 to wirelessly send images and sounds to a remote view screen 113 and speaker 114. The camera 115 may be pivotally coupled to the housing 30 to allow the camera 115 to be directed where needed. The camera 115 and microphone 111 may be electrically coupled to the control circuit 57 for activation by the remote actuator 70. Further, the view screen 113 and speaker 114 may be mounted on the remote actuator 70 and the transmitter 76 and receiver 25 would be replaced by transceivers.

In use, a child is placed in the housing 30 and the housing 30 may be rocked as needed for the child's comfort. To further sooth the child, the housing may be vibrated or music played by the audio player. To further assist a caregiver, the bottle warmer 77 represents a convenient location for heating a bottle. The housing 30 may be lowered or raised relative to the support, or the support lowered or raised with the telescopic legs 15, to provide easy access to the child.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bassinet apparatus comprising:

a support including a first upper panel and a second upper panel, a plurality of legs being attached to and extending downwardly from each of said first and second upper panels so that each of said first and second upper panels has two legs attached thereto, each of said first and second upper panels having an inner face and an outer face, a brace extending between said legs and retaining said first and second upper panels in a vertical orientation;

a housing including a bottom wall and a peripheral wall being attached to and extending upwardly from said bottom wall;

a pair of receivers being attached to said housing;

a pair of mountings, each of said first and second upper panels having one of said mountings attached thereto, each of said receivers receiving one of said mountings to pivotally couple said housing to said support;

a driver assembly being mounted in said first upper panel and selectively rocking said housing with respect to said support;

an actuating assembly being mounted on said support and being in communication with said driver assembly to selectively turn on or turn off said driver assembly;

a remote actuator being in wireless communication with said actuating assembly to wirelessly turn on or off said driver assembly;

a combination remote camera and microphone being attached to said housing, said camera being electrically coupled to a transmitter to wirelessly send images and sounds to a remote view screen and speaker; and said peripheral wall of said housing including a pair of lateral walls and a pair of end walls, each of said end walls having one of said receivers attached thereto, said receivers extending upwardly from said end walls, said bottom wall including a first section and a second section, said first section being hingedly coupled to said second section to allow said first section to be angled, a lift bar being positioned under and pivotally coupled to the first section, said lift bar being lockable into one of a plurality of receiving notches and moved between said receiving notches by a lift actuator extending through said peripheral wall.

2. The apparatus according to claim 1, wherein each of said mountings includes;

a pivot rod extending into an associated one of said receivers and extending through said inner and outer faces, each of said inner and outer faces having vertically aligned spacer notches therein, said pivot rod being selectively positioned in one of said spacer notches to allow selective vertical movement of said pivot rod vertically with respect to said support;

a locking member being releasably extended into the associated one of said receivers and slidably coupled to a corresponding one of said first and second upper panels, said locking member preventing said housing from pivoting with respect to said support.

3. The apparatus according to claim 2, wherein said driver assembly includes:

a motor being mechanically coupled to a plate coupled to said pivot rod positioned in said first upper panel, said drive shaft being rotated alternately in opposite directions when said motor is turned on;

an arm being attached to said housing and extending through said inner wall of said first upper panel; and a connecting rod extending between and coupling together said arm and said drive shaft, said connecting rod moving said arm back and forth with a movement of said drive shaft mechanically coupled to said motor.

4. The apparatus according to claim 3, wherein said actuating assembly includes:

a control circuit being mounted in said support and being electrically coupled to said motor;

a motor switch being mounted on said support and electrically coupled to said control circuit, said motor switch being movable to an on position or off position to selectively turn said motor or on off;

a signal receiver being electrically coupled to said control circuit to receive wireless signals from said remote actuator;

a speed control being electrically coupled to said control circuit and being mounted on said support, said speed control being actuated to adjust a speed of said driver assembly;

said camera and microphone each being electrically coupled to said control circuit to be activated said remote actuator.

5. The apparatus according to claim 1, further including a vibration assembly being mounted in said support and vibrating said support and said housing when said vibration assembly is turned on, said vibration assembly including an oscillator mounted within one of said first and second upper panels and a vibration switch in electrical communication with said oscillator.

6. The apparatus according to claim 5, wherein:

wherein said actuating assembly includes;

a control circuit being mounted in said support and being electrically coupled to said driver assembly;

a motor switch being mounted on said support and electrically coupled to said control circuit, said motor switch being movable to an on position or off position to selectively turn said driver assembly or on off;

a signal receiver being electrically coupled to said control circuit to receive wireless signals from said remote actuator; and a speed control being electrically coupled to said control circuit and being mounted on said support, said speed control being actuated to adjust a speed of said driver assembly;

said remote actuator includes;

a transmitter to send a wireless signal to said signal receiver;

a first actuator being electrically coupled to said transmitter, said transmitter sending a signal to said control circuit to turn on said driver assembly when said first actuator is actuated;

a second actuator being electrically coupled to said transmitter, said transmitter sending a signal to said control circuit to turn off said driver assembly when said second actuator is actuated; and a vibration actuator being electrically coupled to said transmitter, said vibration assembly being electrically coupled to said control circuit, said transmitter sending a signal to said control circuit to turn on said vibration assembly when said vibration actuator is actuated.

7. The apparatus according to claim 6, further including a sound playing assembly being mounted to said support.

8. The apparatus according to claim 7, wherein:

said sound playing assembly includes:

an audio player including a plurality of electrically recorded sounds;

an audio switch electrically coupled to said audio player, said audio switch being movable to an on position or off position to selectively turn said audio player or on off;

at least one speaker being electrically coupled to said audio player and audibly playing said electronically recorded sounds when said audio player is turned on, said speaker being positioned in said housing;

a volume control being mounted on said support, a volume level of sound emitted by said at least one speaker being adjusted by actuating said volume control;

said remote actuator includes;

an audio actuator being electrically coupled to said transmitter, said sound playing assembly being electrically coupled to said control circuit, said transmitter sending a signal to said control circuit to turn on said audio player when said audio actuator is actuated.

9. The apparatus according to claim 8, further including a bottle warmer being mounted on said support, said bottle warmer including a sleeve into which a bottle is removably positioned, said bottle warmer including heating elements to warm said sleeve, a warming switch being electrically coupled to said bottle warmer, said warming switch being movable to an on position or an off position to selectively turn said bottle warmer on or off.

10. The apparatus according to claim 5, further including a bottle warmer being mounted on said support, said bottle warmer including a sleeve into which a bottle is removably positioned, said bottle warmer including heating elements to warm said sleeve, a warming switch being electrically coupled to said bottle warmer, said warming switch being movable to an on position or an off position to selectively turn said bottle warmer on or off.

11. The apparatus according to claim 10, further including a sound playing assembly being mounted to said support.

12. The apparatus according to claim 1, further including a sound playing assembly being mounted to said support.

13. The apparatus according to claim 12, wherein said sound playing assembly includes:

an audio player including a plurality of electrically recorded sounds;

an audio switch electrically coupled to said audio player, said audio switch being movable to an on position or off position to selectively turn said audio player or on off;

at least one speaker being electrically coupled to said audio player and audibly playing said electronically recorded sounds when said audio player is turned on, said speaker being positioned in said housing;

a volume control being mounted on said support, a volume level of sound emitted by said at least one speaker being adjusted by actuating said volume control.

14. The apparatus according to claim 1, further including a bottle warmer being mounted on said support, said bottle warmer including a sleeve into which a bottle is removably positioned, said bottle warmer including heating elements to warm said sleeve, a warming switch being electrically coupled to said bottle warmer, said warming switch being movable to an on position or an off position to selectively turn said bottle warmer on or off.

15. A bassinet apparatus comprising:

a support including a first upper panel and a second upper panel, a plurality of legs being attached to and extending downwardly from each of said first and second upper panels so that each of said first and second upper panels has two legs attached thereto, each of said first and second upper panels having an inner face and an outer face, a brace extending between said legs and retaining said first and second upper panels in a vertical orientation, each of said legs being telescopic and having an adjustable height, said brace including a horizontally oriented tray and a perimeter wall being attached to and extending upwardly from said tray;

a housing including a bottom wall and a peripheral wall being attached to and extending upwardly from said bottom wall, said peripheral wall including a pair of lateral walls and a pair of end walls, a shroud being attached to said peripheral wall and being selectively positioned in an extended position covering a portion of an opening defined by an upper edge of said peripheral wall or in a collapsed position, said bottom wall including a first section and a second section, said first section being hingedly coupled to said second section to allow said first section to be angled, a lift bar being positioned under and pivotally coupled to the first section, said lift bar being lockable into one of a plurality of receiving notches and moved between said receiving notches by a lift actuator extending through said peripheral wall;

a pair of receivers being attached to said housing, each of said end walls having one of said receivers attached thereto, said receivers extending upwardly from said end walls;

a pair of mountings, each of said first and second upper panels having one of said mountings attached thereto, each of said receivers receiving one of said mountings to pivotally couple said housing to said support, each of said mountings including;

a pivot rod extending into an associated one of said receivers and extending through said inner and outer faces, each of said inner and outer faces having vertically aligned spacer notches therein, said pivot rod being selectively positioned in one of said spacer notches to allow selective vertical movement of said pivot rod vertically with respect to said support;

a locking member being releasably extended into the associated one of said receivers and slidably coupled to a corresponding one of said first and second upper panels, said locking member preventing said housing from pivoting with respect to said support;

a driver assembly being mounted in said first upper panel and selectively rocking said housing with respect to said support, said driver assembly including;

a motor being mechanically coupled to a plate attached to said pivot rod positioned in said first upper panel, a drive shaft is attached to the motor which is rotated alternately in opposite directions when said motor is turned on;

an arm being attached to said housing and extending through said inner wall of said first upper panel;

a connecting rod extending between and coupling together said arm and said drive shaft, said connecting rod moving said arm back and forth with a movement of said drive shaft mechanically coupled to said motor;

an actuating assembly being in communication with said driver assembly to selectively turn on or turn off said driver assembly, said actuating assembly including;

a control circuit being mounted in said support and being electrically coupled to said motor;

a motor switch being mounted on said support and electrically coupled to said control circuit, said motor switch being movable to an on position or off position to selectively turn said motor or on off;

a speed control being electrically coupled to said control circuit and being mounted on said support, said speed control being actuated to adjust a speed of said motor;

a signal receiver being electrically coupled to said control circuit;

a vibration assembly being mounted in said support and vibrating said support and said housing when said vibration assembly is turned on, said vibration assembly including an oscillator mounted within one of said first and second upper panels and a vibration switch in electrical communication with said oscillator;

a sound playing assembly being mounted to said support, said sound playing assembly including;

an audio player including a plurality of electrically recorded sounds;

an audio switch electrically coupled to said audio player, said audio switch being movable to an on position or off position to selectively turn said audio player or on off;

at least one speaker being electrically coupled to said audio player and audibly playing said electronically recorded sounds when said audio player is turned on, said speaker being positioned in said housing;

a volume control being mounted on said support, a volume level of sound emitted by said at least one speaker being adjusted by actuating said volume control;

a remote actuator being in wireless communication with said actuating assembly, said remote actuator including;

a transmitter to send a wireless signal to said signal receiver;

a first actuator being electrically coupled to said transmitter, said transmitter sending a signal to said control circuit to turn on said motor when said first actuator is actuated;

a second actuator being electrically coupled to said transmitter, said transmitter sending a signal to said control circuit to turn off said motor when said second actuator is actuated;

a vibration actuator being electrically coupled to said transmitter, said vibration assembly being electrically coupled to said control circuit, said transmitter sending a signal to said control circuit to turn on said vibration assembly when said vibration actuator is actuated;

an audio actuator being electrically coupled to said transmitter, said sound playing assembly being electrically coupled to said control circuit, said transmitter sending a signal to said control circuit to turn on said audio player when said audio actuator is actuated; and a bottle warmer being mounted on said support, said bottle warmer including a sleeve into which a bottle is removably positioned, said bottle warmer including heating elements to warm said sleeve, a warming switch being electrically coupled to said bottle warmer, said warming switch being movable to an on position or an off position to selectively turn said bottle warmer on or of; and a combination remote camera and microphone being attached to said housing and being directed toward said bottom wall, said camera and microphone being electrically coupled to said transmitter to wirelessly send images and sounds to a remote view screen and remote speaker.

16. The apparatus according to claim 15, wherein said camera is pivotally coupled to said housing to allow said camera to be directed where needed.

17. The apparatus according to claim 15, wherein said camera and microphone are electrically coupled to said control circuit for activation by said remote actuator.

18. The apparatus according to claim 15, wherein said view screen and remote speaker is mounted on said remote actuator.

* * * * *